United States Patent [19]

Abildgaard et al.

[11] Patent Number: 4,927,310

[45] Date of Patent: May 22, 1990

[54] METHOD FOR AUTOMATICALLY JUSTIFYING, ASSEMBLING, AND BINDING BOOKS

[75] Inventors: William H. Abildgaard, Redwood City, Calif.; Charles Chadwick, Old Saybrook, Conn.; Peter Hotkowski, Deep River, Conn.; Frank A. Todaro, Clinton, Conn.

[73] Assignee: VeloBind, Inc., Fremont, Calif.

[21] Appl. No.: 315,490

[22] Filed: Feb. 27, 1989

Related U.S. Application Data

[62] Division of Ser. No. 116,045, Nov. 2, 1987, Pat. No. 4,848,616.

[51] Int. Cl.[5] ..... B42B 5/08

[52] U.S. Cl. ..... 412/7; 412/43

[58] Field of Search ..... 412/7, 43

[56] References Cited

U.S. PATENT DOCUMENTS

| | | | |
|---|---|---|---|
| Re. 28,202 | 10/1974 | Abildgaard | 281/21 |
| 3,730,560 | 5/1973 | Abildgaard | 281/21 |
| 3,811,146 | 5/1974 | Abildgaard et al. | 412/43 X |
| 4,369,013 | 1/1983 | Abildgaard et al. | 412/43 X |

*Primary Examiner*—Paul A. Bell

*Attorney, Agent, or Firm*—Julian Caplan

[57] ABSTRACT

Male and female book binding strips are packaged in cassettes and the respective cassettes are stacked in male and female hopper stations. Punched sheets are deposited in a staging station. The components of the book are then assembled in an assembly station. Thus the stack of sheets is fed onto one jaw and one male strip is fed onto that jaw while a female strip is fed onto the opposite jaw superimposed above the first-mentioned jaw. The two jaws are moved toward each other until the stack is loosely held therebetween. Thereupon the jaws are pivoted to vertical position, the stack resting on a base plate attached to one one jaw. The stack is jogged so that the holes in the sheets are aligned with each other and with the holes in the female strip. The male strip is pushed inward toward the stack, the studs fitting through the holes in the sheets and through the female strip. The assembled staack and strips are then moved into a bind station where the strips are compressed together, excess stud length cut off and rivet heads formed on the severed ends of the studs.

12 Claims, 10 Drawing Sheets

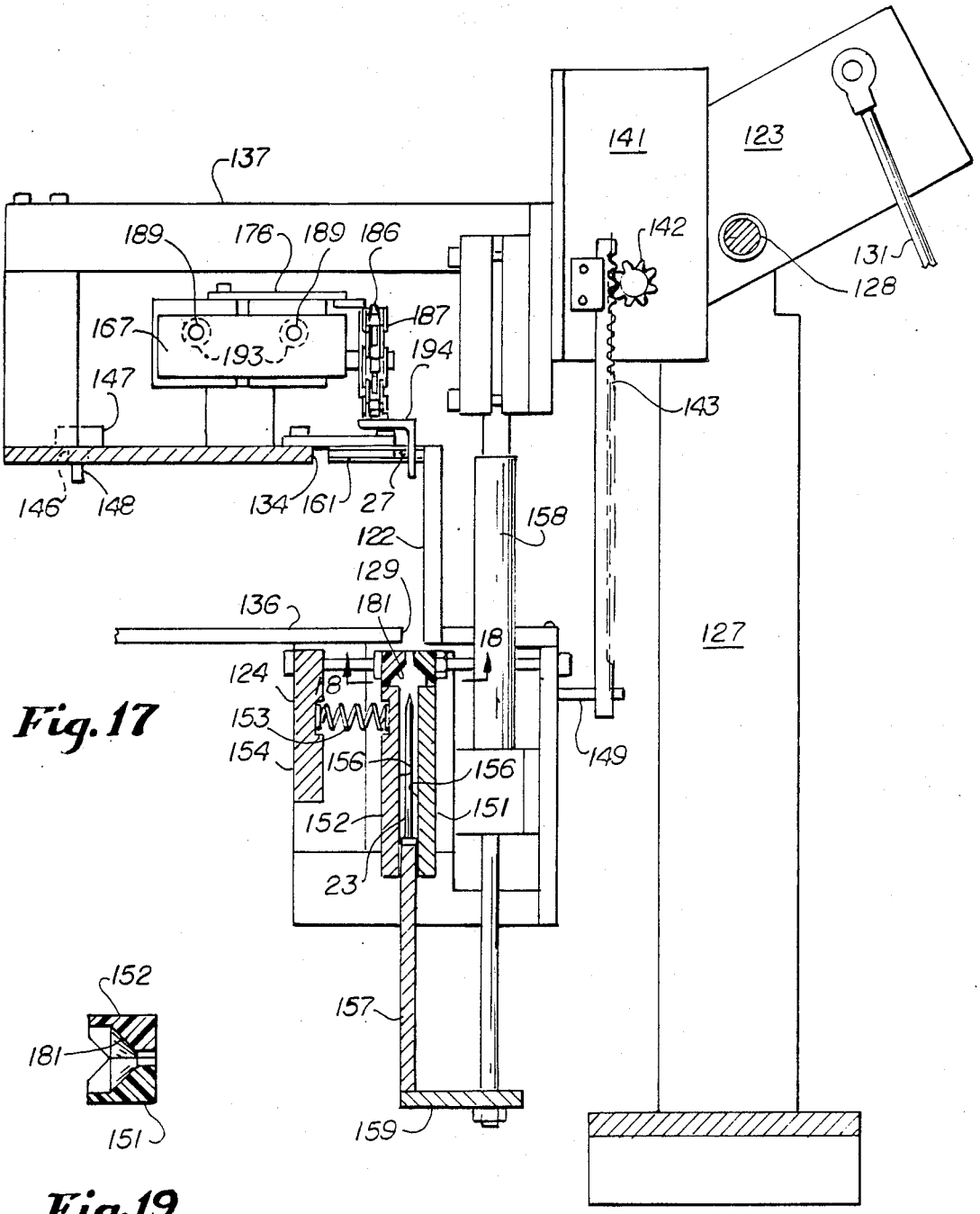
Fig. 17
Fig. 19
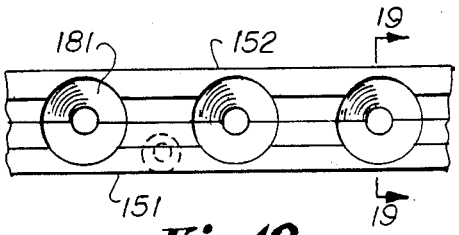
Fig. 18

METHOD FOR AUTOMATICALLY JUSTIFYING, ASSEMBLING, AND BINDING BOOKS

This is a division, of application Ser. No. 116,045 filed 11/02/87 now Pat. No. 4,848,616.

BACKGROUND OF THE INVENTION

1. Field of the Invention

The present invention comprises apparatus and method for automatically justifying sheets which are punched with holes spaced inward from one margin of the sheet by squaring the said one margin and two end margins so that the holes of the sheets are aligned, assembling such sheets with male and female plastic binding strips and then binding the sheets into books by compressing the strips so that the studs of one strip pass through the holes in the paper and the holes of the other binding strip, and then cutting off the excess stud length and forming rivet heads on the ends of the studs.

As hereinafter described in detail, the machine has a frame supported above the floor on which are mounted several stations or subassemblies. At the staging station the sheets to be bound are deposited on a tray from which they are fed into the assembly station. Male binding strips packaged in cassettes are deposited in a male strip hopper and fed one at a time from the cassette and then fed laterally into the justify/assembly station. Simultaneously, in a female strip hopper the strips are fed one at a time from a cassette and then cross-fed laterally into the justify/assembly station. In the justify/assembly station, the sheets are jogged so as to square the edges of the sheets in common planes and thereby align the holes in the sheets. After such justification is completed, the male strips are pushed inward through the aligned holes in the sheets and through the holes in the female strip and then the assembled document is fed into the binding station. The binding station may be of several types using, for example, substantial portions of the machine shown in U.S. Pat. No. 3,811,146, whereby the strips are compressed together, thereby compressing the sheets therebetween, the excess stud lengths are cut off and heads are formed on the severed ends of the studs, binding the book together.

2. Description of Related Art

Books of the general type of the end product of the present invention are shown, among other places, in U.S. Reissue Pat. No. 28202. Such books employ male and female binding strips such as are shown in FIGS. 1 and 2 of U.S. Pat. No. 4,369,013. As has been stated, the binding station of the apparatus of the present invention employs a substantial portion of the machine shown in U.S. Pat. No. 3,811,146. Initially, the strips are packaged in cassettes such as are disclosed in U.S. patent application Ser. No. 115,999, filed Nov. 2, 1987, entitled CASSETTE FOR BOOKBINDING STRIPS, the inventors being Barney A. Tipps and Frank A. Todaro, now Pat. No. 4,844,674.

SUMMARY OF THE INVENTION

The apparatus of the present invention has several stations. In the staging station, the punched sheets are deposited in a tray. Although not shown in the accompanying drawings, it will be understood that the sheets may be deposited manually in such a tray or may be fed from a printer such as a laser printer or from a copy machine. The sheets are prepunched with holes spaced along one edge distances equal to the distances between the studs of the male strips heretofore mentioned. The stack of sheets at an appropriate time is fed into the justify/assembly station.

At another location in the apparatus, cassettes containing male strips are stacked one on top of the other. The male strips are fed one at a time from the bottom cassette and then one strip at a time is fed transversely into the justify/assembly station in a position adjacent the stack of sheets and with the studs of the male strip aligned with the holes in the sheets. At a corresponding station on the machine, the cassettes of female strips are stacked one on the other and the strips are fed out of the bottom-most cassette and then fed transversely one at a time into the justify/assembly station with the female strip on the side of the stack opposite the male strip and with the holes in the female strip aligned with the holes in the stack.

The justify/assembly station comprises a pair of jaws and their mounting structure which are movable from a horizontal position during which the sheets are fed from the staging station and the strips are fed from the cassettes. The justify/assembly station is then pivoted to a position where the sheets are vertical and the sheets are then jogged so as to justify the same--that is, the edges of the sheets along which the holes are disposed, as well as the end edges of the stack, are squared thereby aligning the holes in all of the sheets. As soon as this operation is completed, the male strip is advanced toward the stack so that the studs penetrate the holes in the sheets of the stack and also penetrate the holes in the female strip. Thereupon the stack of sheets and strips are fed transversely into the bind station.

At the bind station, the male strips are compressed against the stack of sheets, while the female strip is held stationary, thereby creating a tight bind. Thereupon the binding machine cuts off the excess stud lengths, preferably by hot knife blades and then forms rivet heads on the ends of the studs, thereby completing the bind.

Accordingly, it is a principal object of the present invention to mechanically perform bookbinding operations which have heretofore required a series of manual operations.

One of the advantages of the invention is a considerable increase in the speed with which the sheets of a book and the binding strips may be assembled and bound, thereby making it possible to bind a book substantially as fast as the pages of the book are printed or copied.

Another feature of the invention is the reduction in labor which is accomplished by use of the apparatus and, further, that the labor required is considerably less skilled than in conventional bookbinding.

The present invention, therefore, is a logical development of instant book publishing in that it provides a very superior binding for a book in line with a laser or other type printer or copier. The output of the printer or copier is automatically bound.

Hard cover books, such as that shown in U.S. Pat. No. 3,730,560, may be desirable in some instances. For such purpose the end sheets which are shown in such patent or those commercially available from the assignee of this patent application are bound on the top and bottom of the stack, the end leaves being either manually or automatically placed on the front and back of the stack. After the binding station has completed its operation, there are end sheets bound into the book. Hard covers or cases may be applied to the core of the book by means such as that shown in said Pat. No. 3,730,560.

Other objects of the present invention will become apparent upon reading the following specification and referring to the accompanying drawings in which similar characters of reference represent corresponding parts in each of the several views.

IN THE DRAWINGS

FIG. 17 is an enlarged view of portions of FIG. 11 partially broken away to reveal internal construction.

FIG. 18 is a fragmentary enlarged view along line 18—18 of FIG. 17.

FIG. 19 is a sectional view along line 19—19 of FIG. 18.

DESCRIPTION OF PREFERRED EMBODIMENTS

Supplies Used with the Apparatus

Figure 1:
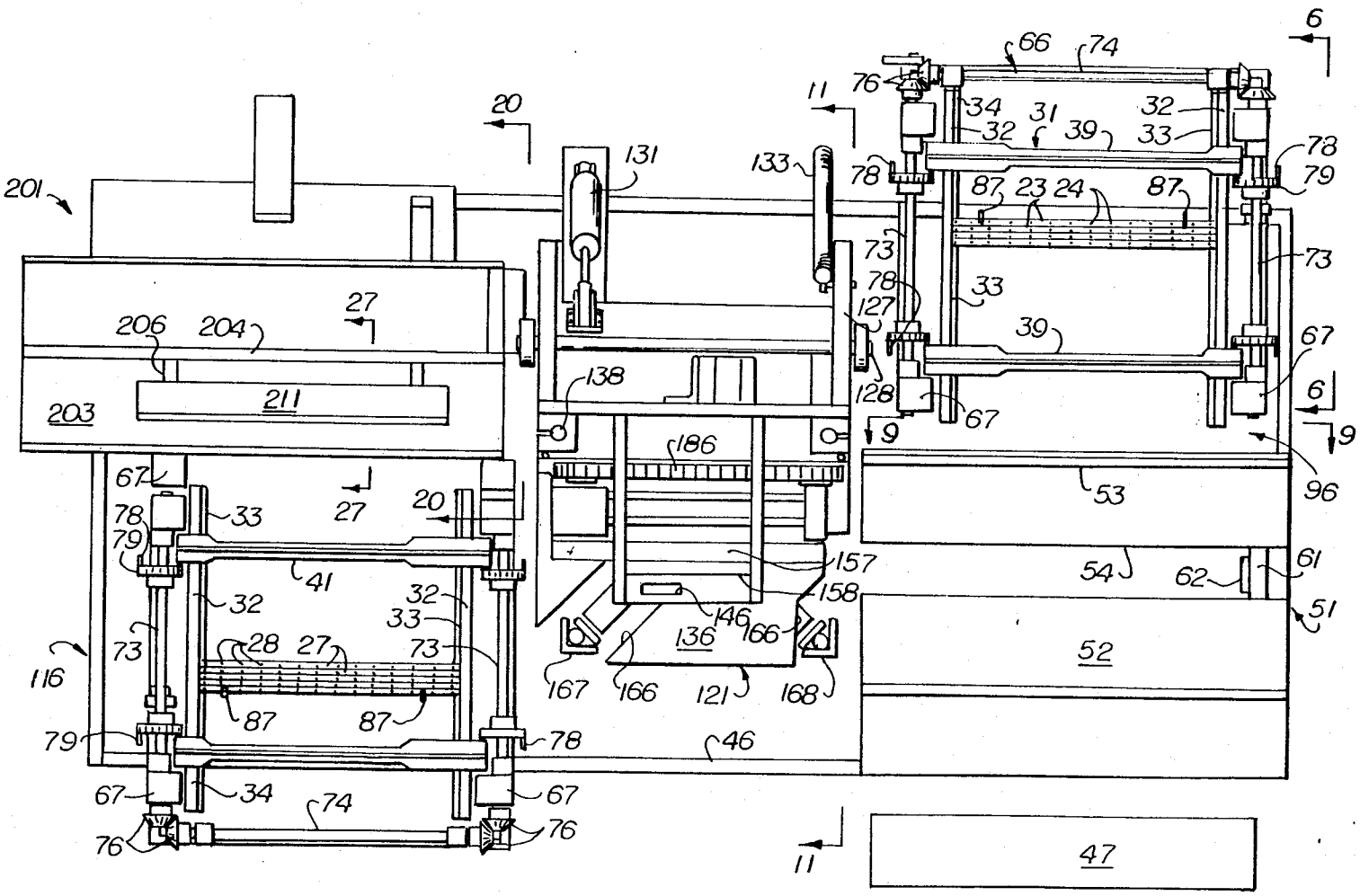
FIG. 1 is a plan view of the machine with parts omitted for clarity of illustration.

Sheets 21 are formed with holes 22 spaced apart along one edge of sheet 21 and spaced inwardly from said one edge. Such sheets are preferably drilled or prepunched and are delivered from a laser printer or copy machine with printed or graphic material thereon.

Male thermoplastic binding strips 23 are preferably of a type commercially available and are formed with studs 24 having their ends 26 pointed spaced along the strip 23 distances complementary to the spacing of the holes 22. Preferably there is a space between the end of each strip and the outermost stud 26 to fit into the cassette 31 hereinafter described. For each strip 23 there is a female strip 27 of the same length formed with holes 28 spaced the same distances as the holes 22 and studs 24. Counterbores 29 are formed surrounding holes 28 on one side of the strip 27 to receive the rivet heads which are formed therein at the binding station of the apparatus.

The male strips 23 are preferably packaged in cassettes 31 shown schematically in the accompanying drawings. Such cassettes have longitudinal rails 32 formed with opposed inward facing channels 33 of a thickness equal to the thickness of the strips 23. The ends of the strips 23 outward of the outermost studs 24 are received in channels 33. One end of cassette 32 is formed with a closure to prevent escape of strips. The opposite end of the channel is formed with a detent 36 having a lever 37 connected thereto. Detent 36 blocks discharge of strips 23 until, during the operation of the apparatus hereinafter described, the lever 37 is bent backward, making the detent 36 inoperative. Posts 38 are positioned on rails 32, the lengths of the posts being somewhat greater than the lengths of the studs 24. Transverse cross rails 39 are connected to the upper ends of the posts 38. Thus a plurality of strips 23 may be packaged in the cassette 31 and transported without displacement of the strips until the appropriate time in the cycle of operation of the apparatus hereinafter described. It will be seen that the space below the level of the lowermost cross rail 39 is unobstructed thereby enabling the male strip feeding mechanism hereinafter described to function unimpeded.

A female cassette 41 is used to package the female strips 27. Such cassette 41 is identical to the cassette 31 except that there are no posts or legs 38 required. The same reference numerals are used to describe the elements of the cassette 41 as the cassette 31.

The specific details of construction and assembly of cassettes 31 and 41 are described in considerably greater detail in the aforesaid Tipps and Todaro patent application now Pat. No. 4,844,674.

It is desirable that the cassettes 31 be stacked on top of each other so that they are automatically fed into the machine and likewise that the cassettes 41 be stacked on top of each other. For such purpose, notches 42 may be cut into the lower edges of rails 32 to receive the ridges 43 on the tops of the cross rails 39.

Frame and Controls

The apparatus of the present invention is preferably supported above floor level by a frame 46 of irregular shape which may be cast or fabricated as desired. The individual members of the frame 46 are not called out in detail, it being understood that the structure of the frame 46 is subject to considerable variation. Preferably provision is made for the empty cassettes 31 and 41 to drop into a bin below the frame and, furthermore, that the ends of the studs 24 after they have been cut off should also be deposited in a receptor. Portions of the mechanisms of the apparatus also extend below the bottom level of the frame. Accordingly, a support for frame 46 is desirable, raising the frame above floor level.

A control box 47 contains controls for automatic operation of the apparatus. As a matter of design choice, a considerable number of pneumatic cylinders are employed and some electric motors are also used. Various sensors are located at various positions in the apparatus to sense proper operation of the mechanical movements and only a few of these sensors are described in the following specification or illustrated in the drawings. However, the valves for the pneumatic control lines are located in the control box, as are the switches which control the electrical system. The controls are programmed for proper sequential movement and also to ensure that the machine does not continue to operate unless the various position sensors are properly actuated.

The various wires leading to sensors and motors and the various pneumatic lines leading to cylinders are omitted in the drawings since their presence on the drawings would be confusing and obscure working elements. How such switches, wires, sensors and tubing would be located will be readily understood by those skilled in the machine design art.

For ease in describing the operation of the various elements of the machine it will be assumed that as viewed in FIG. 1, the front of the machine is the bottom of the figure and the rear of the machine is the top of the figure and that the right-hand edge is the right side of the machine and the left-hand edge as viewed in FIG. 1 is the left-hand side of the machine.

Staging Station

On the front right hand side of the machine is a horizontally disposed tray 52 which receives sheets 21 with the holes 22 rearmost. Sides 53 are spaced apart a distance slightly greater than the width of sheets 21. There is a slot 54 extending transversely of the machine in the bottom of the tray 52.

Located below the level of tray 52 and forwardly thereof is a horizontally disposed pneumatic cylinder 56 and below the forward side 53 of the tray 52 is horizontally disposed shaft 57. Vertical slide 58 is provided with linear bearings 59 which slide on shaft 57 and is connected to the rod of cylinder 56. A horizontal crosspiece 61 is fixed to slide 58 and extending up from crosspiece 61 and through the slot 54 is a pusher finger 63. Hence the cylinder 56 when actuated causes the finger 62 to advance from the right to the left hand end of the slot 54 pushing into the justify/assembly station a stack of sheets 21.

Male Strip Hopper Station

Behind the staging station and at a lower elevation is male strip hopper station 66. Four vertical posts 67 are formed with inward-facing notches 68. The front to rear distance between notches 68 is slightly greater than the spacing between the cross rails 39 and the transverse distance between the notches is slightly greater than the length of the cross rails 39 of cassettes 31. Posts 67 are connected to frame 46 in any convenient manner. Extending longitudinally between the right hand posts 67 is a horizontal drive shaft 69 which is driven from motor 71 by belt 72. Above drive shaft 69 is a countershaft 73 and on the opposite side of the male strip hopper station 66 are horizontal countershafts 73 parallel to drive shaft 69. One of the countershafts 73 is driven from drive shaft 69 by means of horizontal transverse cross shaft 74 and bevel gears 76. Four vertically disposed chains 77 are driven by sprockets 79 mounted on the shafts 69 and 73. These chains 77 have at various links thereon outward facing pins 78. The lowermost cassette 31 is supported by pins 78 inasmuch as the cross rails 39 rest thereon.

Cylinder 83 is located along the discharge end of the cassette 31 in unloading position in hopper station 66. Cylinder 83 actuates pivot levers 84 on either side of the station having transverse rod 85 which engages the lever 37 and bends the detent 36 out of operative position so that strips 23 may be unloaded from the cassette.

Sliding movement of the strips 23 along the channels 33 of the cassette 31 is accomplished by horizontally recripocating pusher bar 83 which has fingers 87 extending up to the level of the strips 23. The pusher bar at one end has bearings 88 which slide along horizontal shafts 89 on one side of station 66. Extending down from frame 46 is an abutment extension 91. Pivotally connected to pusher bar 86 is a downward extending clevis member 92 to which is pivotally mounted a cylinder 93, the rod 94 of which is pivotally attached to abutment 91. Thus the cylinder 93 controls reciprocation of the fingers 47 and movement of the fingers 47 relative to the last of the strips 23 in the cassette 31 causes all of the other strips 23 to move one at a time forwardly out of the cassette. Electrical means (not shown) senses full forward movement of pusher bar 83 indicating that all strips have been discharged from the lowermost cassette 31, thereby causing motor 71 to be energized to drop the lowermost cassette out of the machine and cause the next cassette to be lowered into place. Such positioning is sensed by photo-sensor 81, stopping motor 71.

Figure 6:
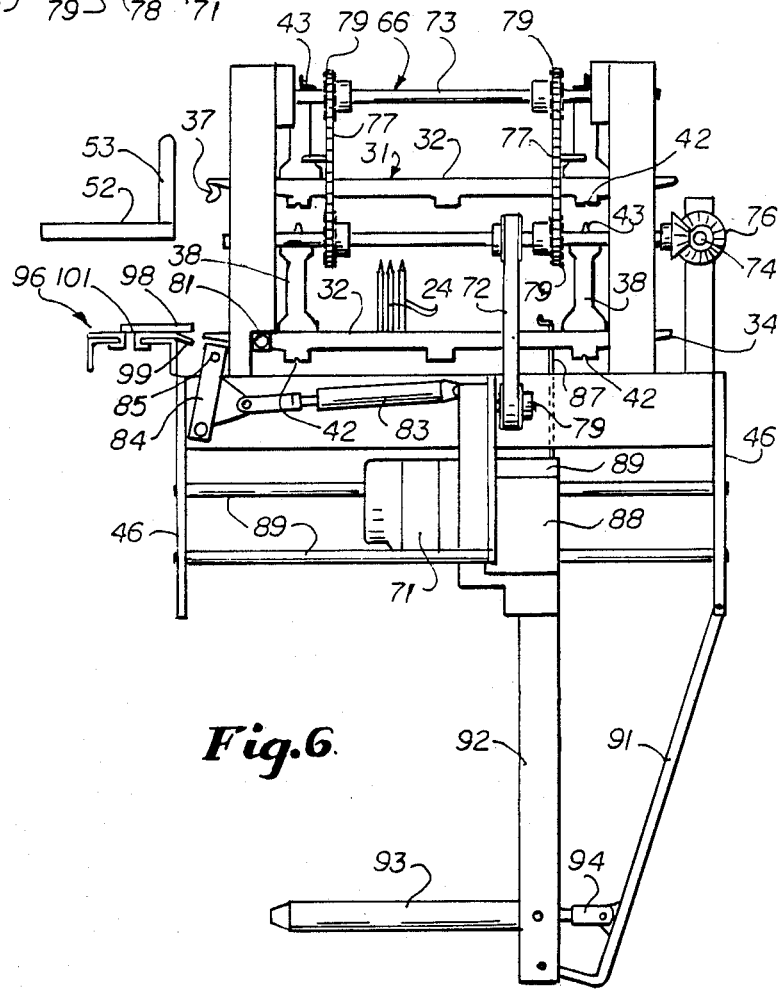
FIG. 6 is a vertical sectional view through the male strip hopper station as viewed along line 6—6 of FIG. 1.
Figure 8:
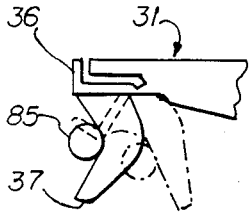
FIG. 8 is an enlarged fragmentary view of a portion of FIG. 7.
Figure 9:
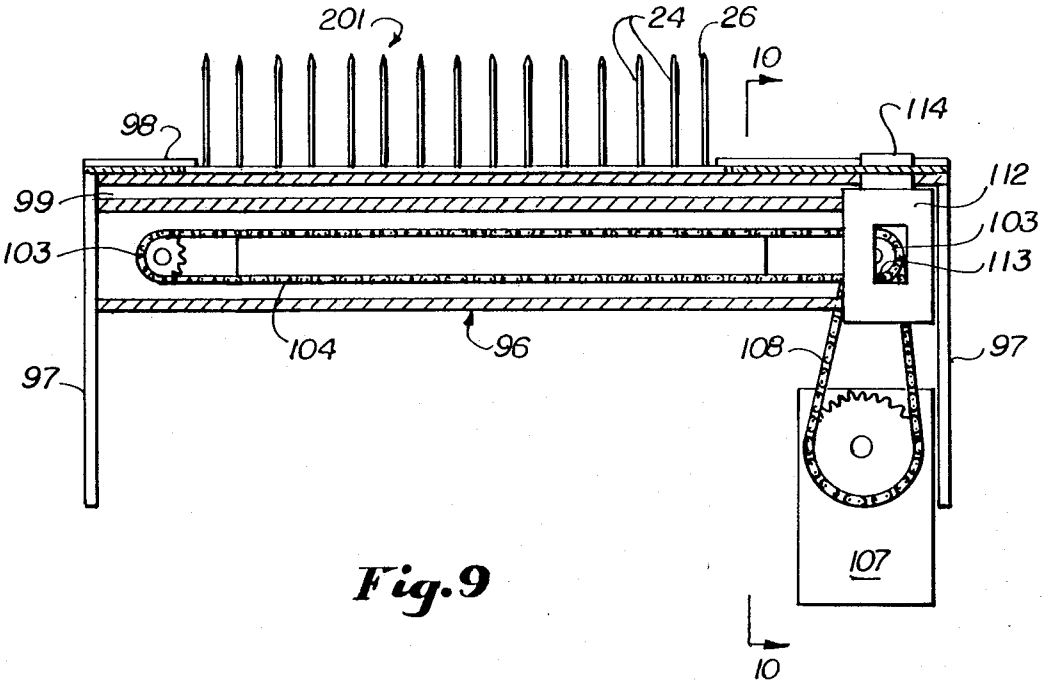
FIG. 9 is a vertical sectional view through the cross-feed of the male strip hopper station taken substantially along line 9—9 of FIG. 1.

Extending transversely of the machine at the foreward end of station 66 is crossfeed 96. Crossfeed 96 is shown in detail in FIGS. 9 and 10. Thus, on either side thereof are end plates 97 which are supportd by the frame 46. Extending horizontally between the end plates 97 is strip guide block 98 and below the block 98 is an infeed table 99, best shown in FIG. 6, onto which the strips 23 discharged from the lowermost cassette 31 move into contact with the strip guide block 98. Forward of block 98 is a backing plate 101 which is spaced forwardly therefrom, providing therebetween a slit 102.

Sprockets 103 are suitably mounted by means not shown with their shafts horizontal and crossfeed chain 104 is driven by said sprockets. Chain guide 106 is horizontally disposed and separates the upper and lower stretches of chain 104. Motor and gear reduction 107 by means of suitable sprockets and chain belt 108 drives the right hand sprocket 103 as viewed in FIG. 9. Parallel to the direction of the top and bottom stretches of chain 104 are upper and lower transverse shafts 111 on which travel bearing block 102 which is connected to one of the links of chain 104 by a link pin 113. Hence the longitudinal movement of block 112 is the length of travel of the chain 104. Strip driver 114 is fixed to bearing block 112 and projects up through slit 102.

Figure 10:
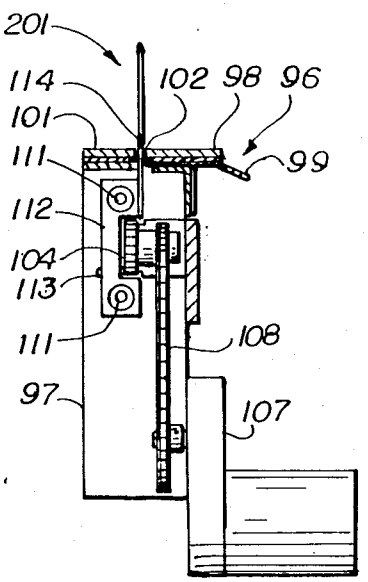
FIG. 10 is a sectional view along line 10—10 of FIG. 9.

One male strip 23 at a time is fed out of cassette 31 onto the infeed table 99 and up between guides 98 to a position whereby the strip 23 is below members 98 and 101 and the studs 24 extend up through the slit 102 (see FIG. 10). At an appropriate time in the cycle of operation, the motor 107 moves the strip driver 114 to move the strip 23 to the left as viewed in FIG. 9 and into the justify/assembly station as hereinafter described.

Female Strip Hopper Assembly

This assembly 116 is located at the left front of the machine and the strips 27 are fed rearwardly out of cassette 41. The details of station 116 are substantially the same as station 66, except that the cassettes 41 holding strips 27 are handled therein. The chains 77*a* are shorter than the chains 77 of station 66 and the distance between the pins 78*a* is shorter than the distance between the pins 78. In other respects the elements of station 116 resemble those of station 66 and the same reference numerals are used to designate corresponding parts. The function of the station 116 is to move the strips 27 rearwardly in cassettes 41 and then to move the strips 27 to the right into the justify/assembly station as hereinafter explained.

Justify/Assemble Station

Figure 11:
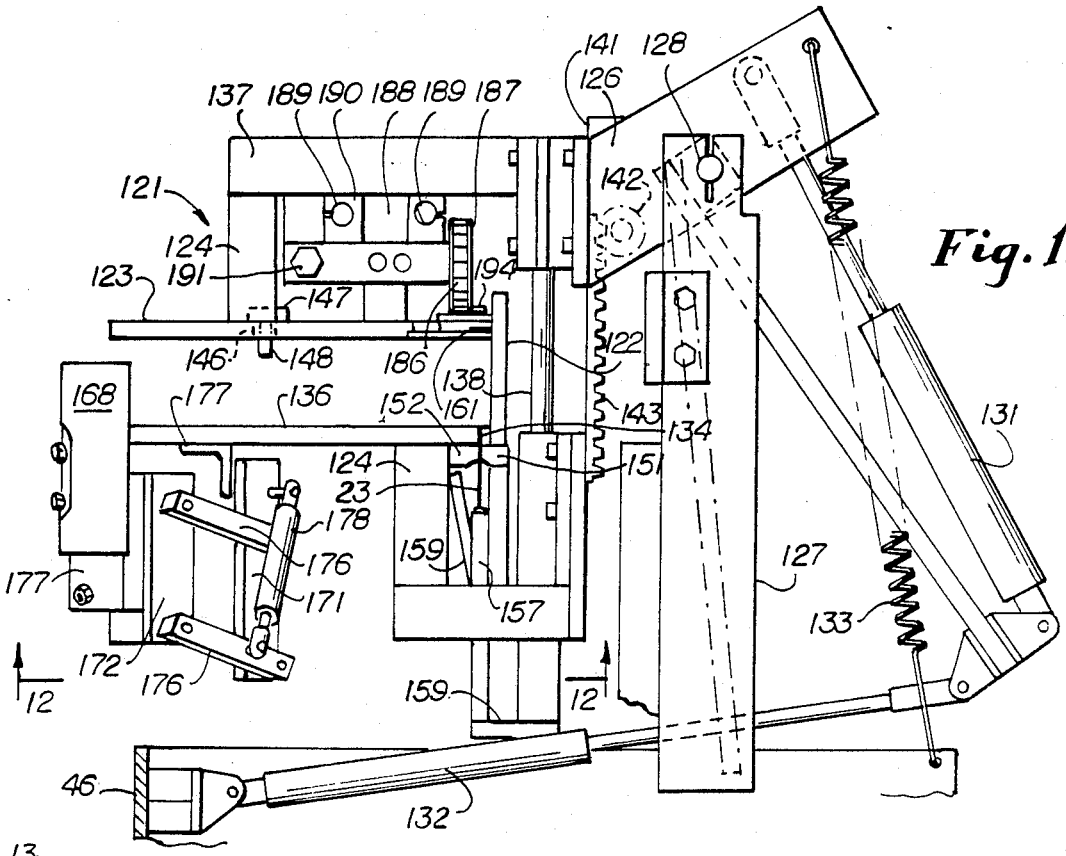
FIG. 11 is a vertical sectional view through the justify/assembly station taken along line 11—11 of FIG. 1.
Figure 12:
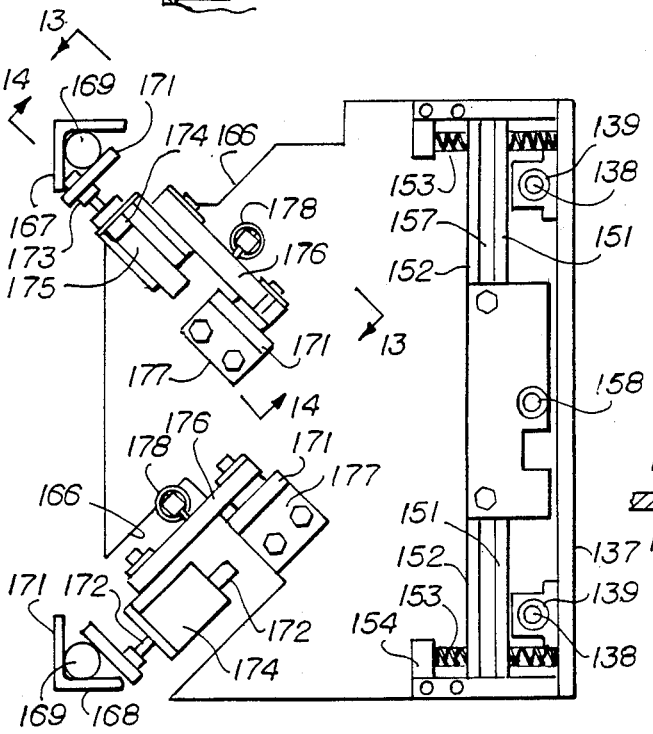
FIG. 12 is a sectional view along line 12—12 of FIG. 11.
Figure 13:
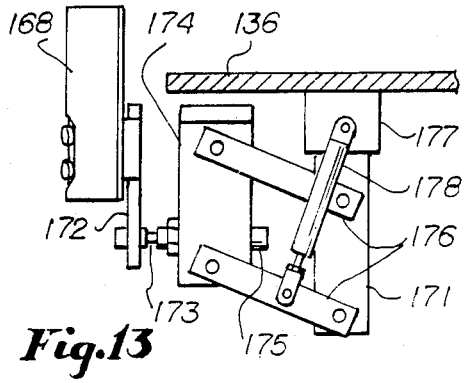
FIG. 13 is a fragmentary sectional view along line 13—13 of FIG. 12.
Figure 14:
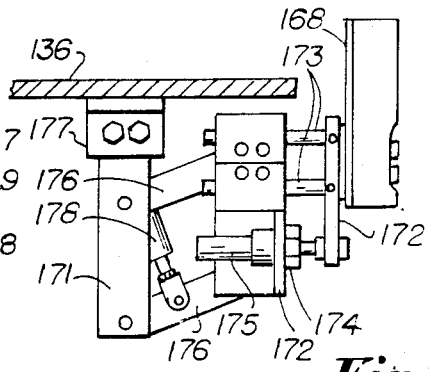
FIG. 14 is a fragmentary sectional view along line 14—14 of FIG. 13.
Figures 15, 16:
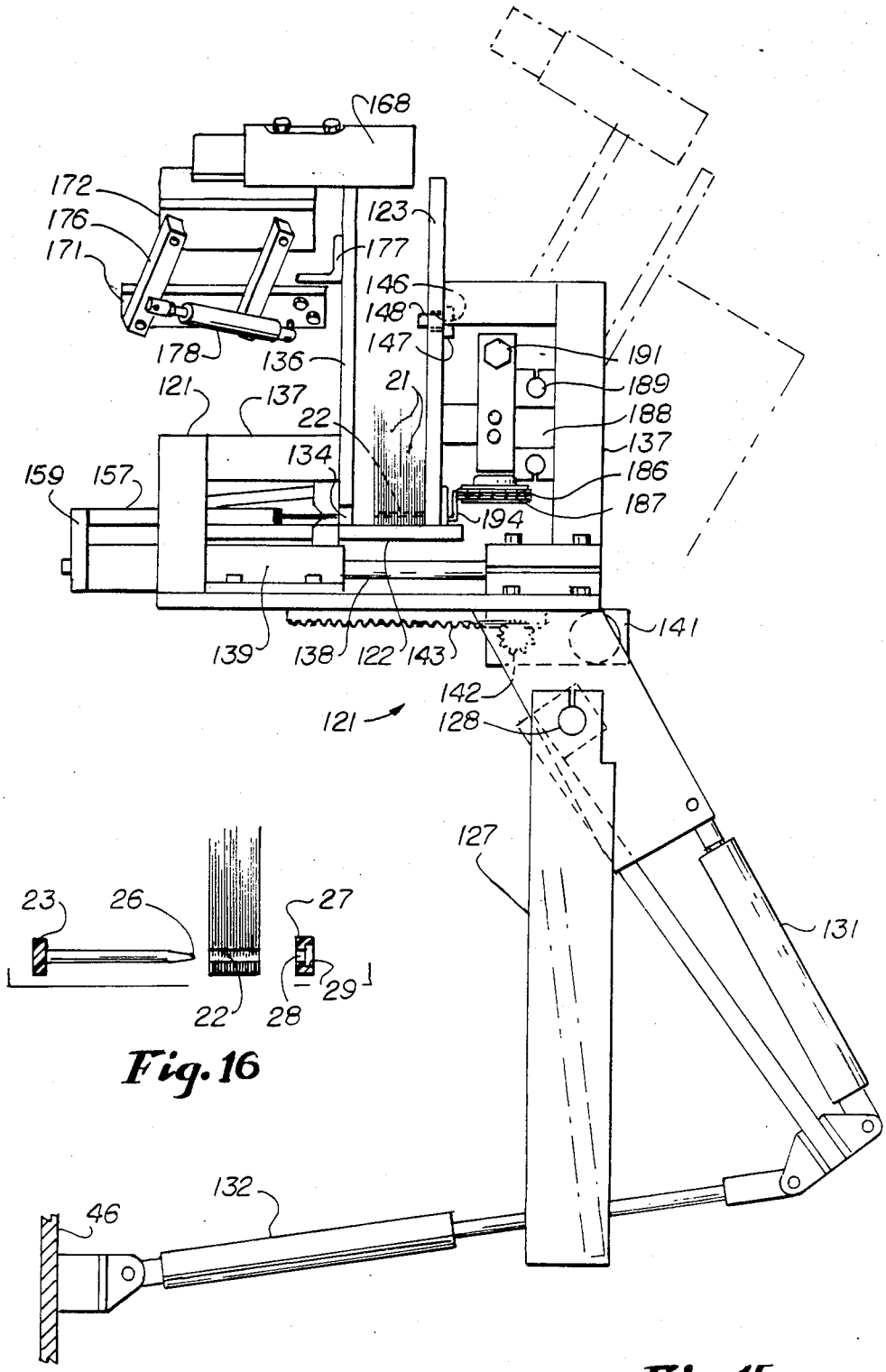
FIG. 15 is a view similar to FIG. 11 showing in solid lines the structure in vertical position and in dot-and-dash lines the structure in retracted position.
FIG. 16 is a schematic exploded view showing the elements of the book in process of assembly in FIG. 15.
Figure 20:
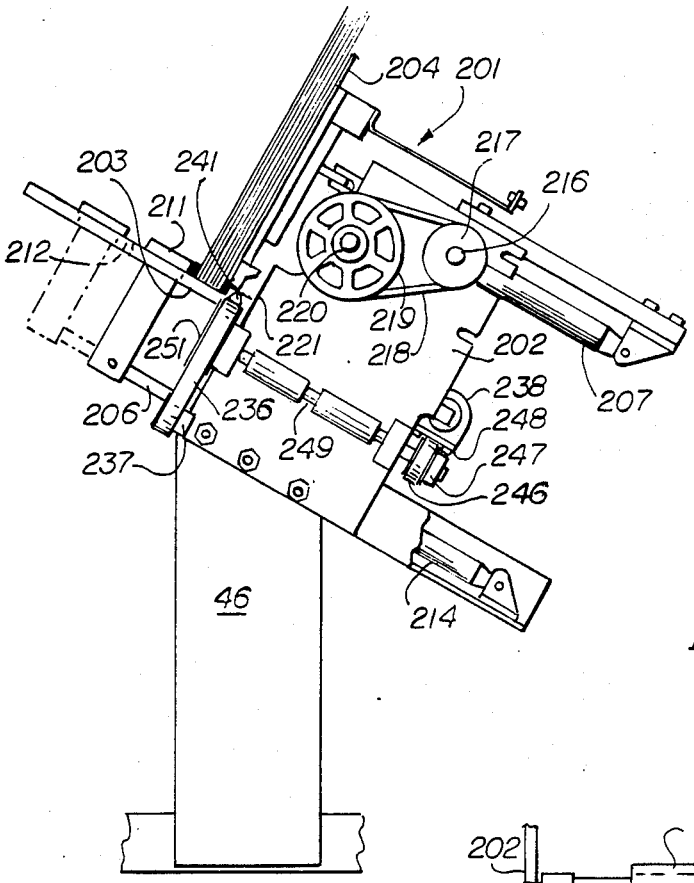
FIG. 20 is a vertical sectional view through the bind station taken substantially along line 20—20 of FIG. 1.
Figure 24:
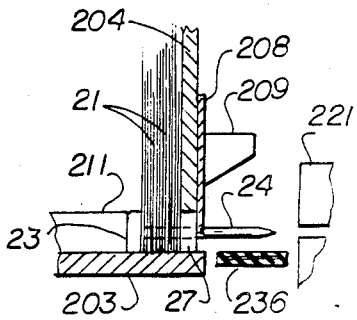
FIG. 24 is a schematic enlarged fragmentary view of a portion of FIG. 20 showing the female strip guard in operative position.
Figure 25:
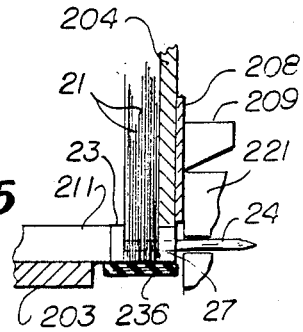
FIG. 25 is a view similar to FIG. 24 showing the guard elevated.
Figure 23:
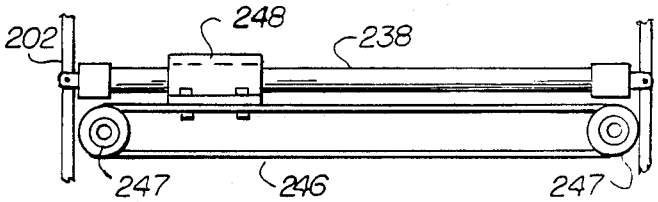
FIG. 23 is a rear elevation of a portion of the structure of FIG. 22 as viewed along line 23—23.

The justify/assemble station 121 is located in the center of the machine. Base plate 122 has a movable jaw 136 extending at right angles thereto. Fixed jaw 123 is parallel to jaw 136 and is spaced from plate 122 by a gap 129 by subframe 124 behind or below the jaw 123. Jaw 136 is separated from plate 122 in a gap 137 and is supported by subframe 137. Extending from subframe 137 are a pair of downward-extending arms 126 in juxtaposition to a main frame extension 127. Pivot pins 128 interconnect arms 126 with extensions 127 so that the plate 122 and jaws 123 and 136 and associated mechanisms may pivot in a vertical plane from a forward or down horizontal position shown in FIG. 11 to a vertical or jogging position shown in solid lines in FIG. 15, to a retracted or rearward slanted position shown in dot-and-dash lines in FIG. 15. The retracted position is preferably slanted back from the vertical approximately 30° so that sheets 21 are supported by jaw 123. A first pneumatic cylinder 131 controls movement of the subframe 137 from the forward to vertical positions and a second cylinder 132 controls movement thereof from the vertical to the rearward position. Counterbalance springs 133 are used to counterbalance the weight of the moving portions of the subassembly.

Guide shafts 138 are fixed to jaw 123 and are received in linear bearings 139 fixed to subframe 137. The movement of jaw 136 relative to jaw 123 is accomplished by motor 141 which drives a pinion 142 meshing with rack 143 fixed to jaw 136 by pin 149. It is intended that the jaws 136 and 123 support the sheets 22 after they have been delivered from the staging station by means of pusher finger 62 but not to clamp the same. Hence an aperture 146 is formed in jaw 123 and to the jaw 123 is mounted a switch 147 having a finger 148 which extends through the aperture 146 and contacts the sheets 21 which (as hereinafter appears) are deposited from the staging station into the space between the jaws when the jaws are in down or forward position. Bearing in mind that the number of sheets in a book may vary, when the finger 148 contacts the sheets, the switch 147 is closed, stopping the motor 141 so that the jaws are a distance apart a finite distance (e.g., about one-quarter inch greater than the thickness of the stack of sheets therebetween).

Figure 2:
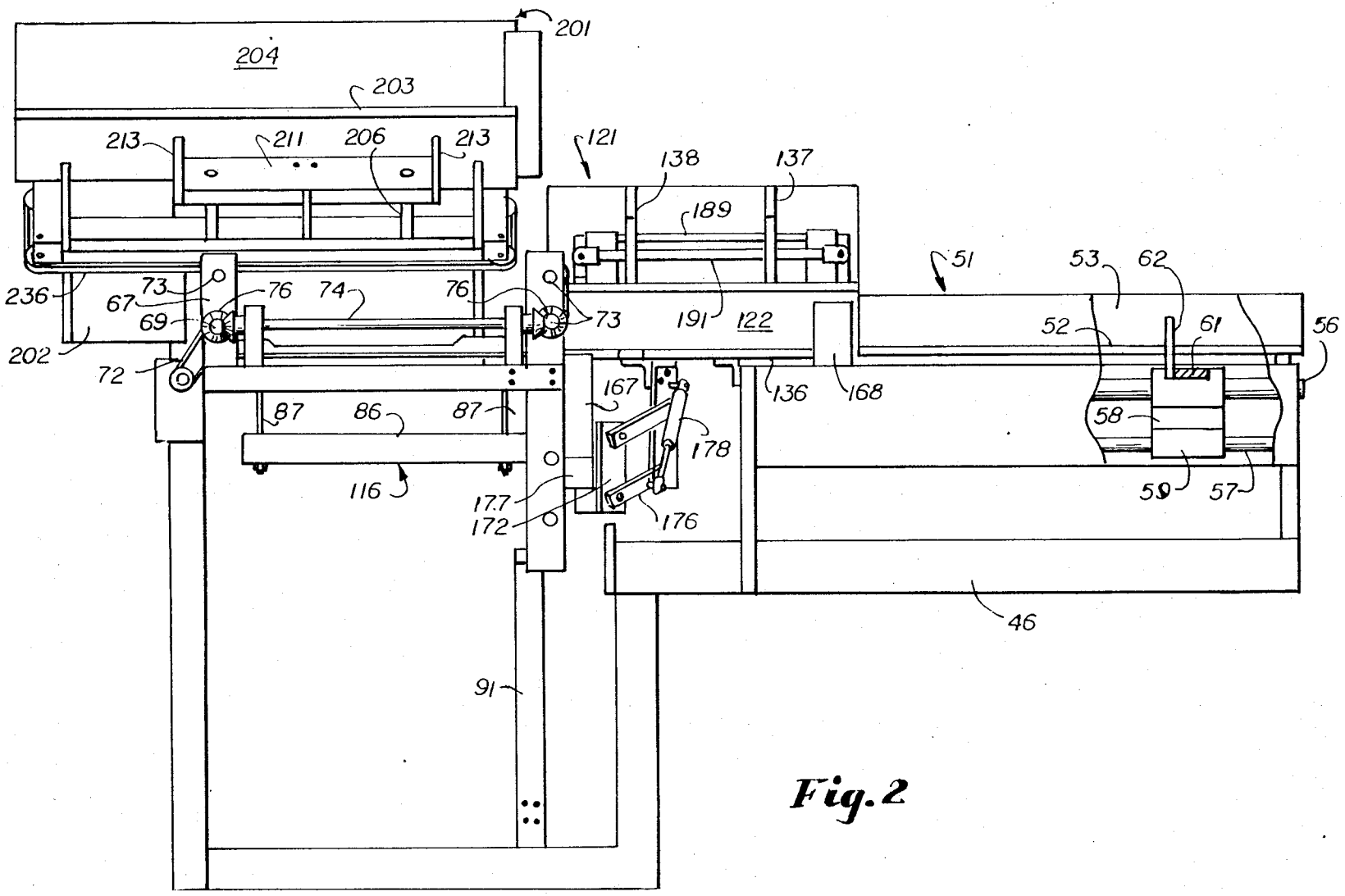
FIG. 2 is a front elevational view thereof.
Figure 3:
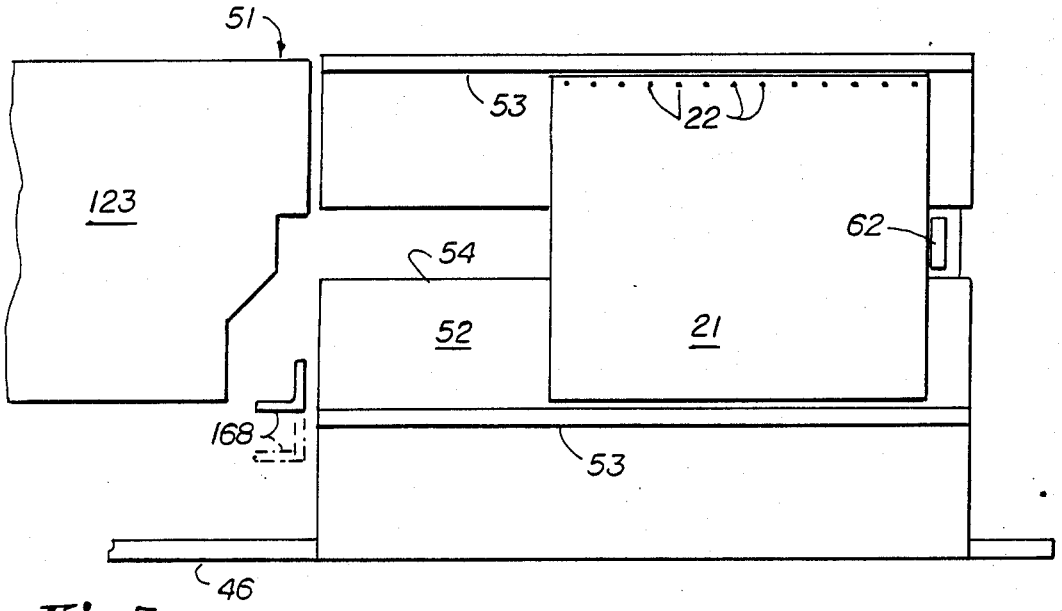
FIG. 3 is a top plan of the staging station.
Figure 4:
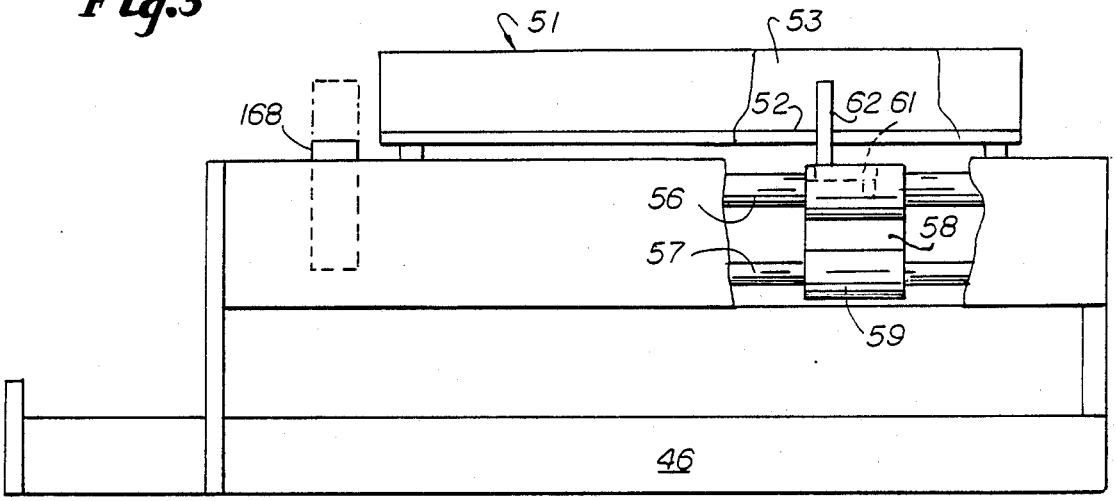
FIG. 4 is a side elevation of the structure of FIG. 3 partly broken away to show internal construction.
Figure 5:
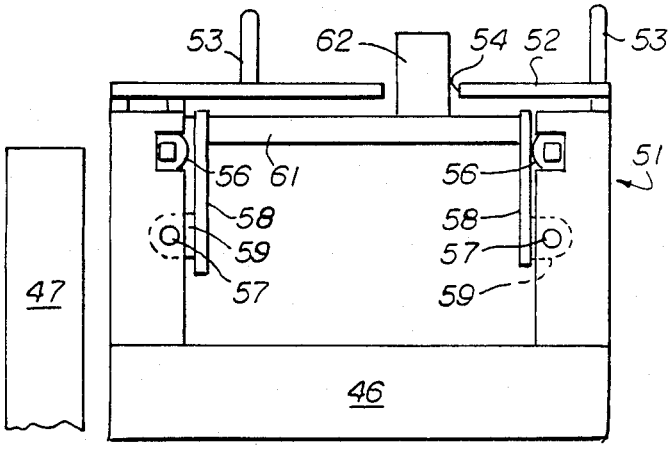
FIG. 5 is an end elevation as viewed from the right of FIG. 3.
Figure 7:
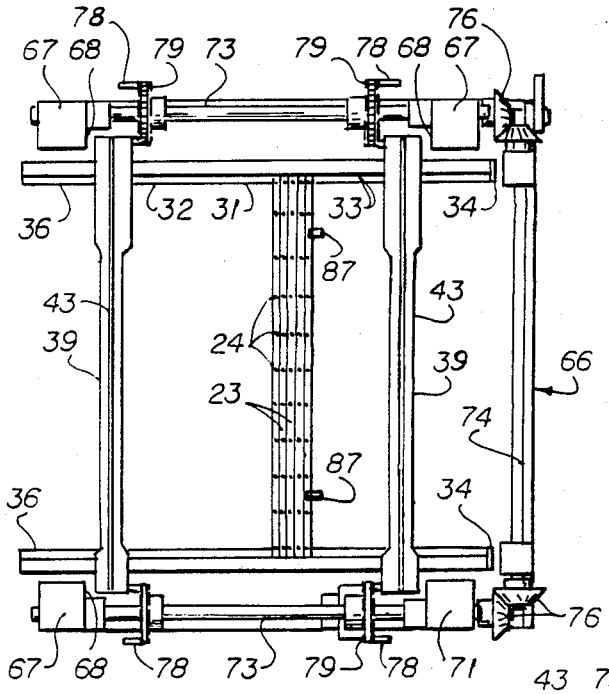
FIG. 7 is a top plan of a portion of FIG. 6.

It will be noted that in the forward or initial position of the movable jaw 136, as best shown in FIG. 2, the upper surface of jaw 136 is slightly lower than the level of tray 152 and hence the finger 62 pushes the stack of sheets out of the tray 52 and onto the jaw 136.

Simultaneously with the delivery of the sheets from the staging station, the male and female strips are also fed into the justify/assembly station. Considering first the transfer of the male strips, mounted on the subframe 124 and at a right angle thereto and extending into gap 129 are male strip lower guide and male strip upper guide 151 and 152, respectively, the latter being biased by springs 153 from abutment 154. Cam-like grooves 156 are formed in the opposed surfaces of guides 151 and 152 spaced the same intervals as the studs 24 on strips 23. The guides 151 and 152 are spaced slightly apart so that when the crossfeed 96 of the male strip hopper feeds the male strips horizontally toward the left, the studs 24 fit between the guides 151 and 152 and the strip is fed until the studs 24 fit in the proper grooves 156. Reciprocating on subframe 137 is a male strip pusher 157 which is attached to support 159 extending at right angles thereto, the support 159 being controlled by an actuator cylinder 158. When the cylinder 158 is actuated, the pusher 157 pushes the male strip 23 inward and when the strip 23 encounters the cam grooves 156, the guides 151 and 152 are forced apart, permitting the pusher 157 to push the male strip out of the guides 151, 152 in the gap 134 between the edge of the movable jaw 136 and the base plate 122 and thereby push the studs 24 through the holes 22 of the sheets 21 positioned between the jaws 123 and 136.

Preferably conical guide surfaces 181 are formed in guides 151 and 152 in alignment with holes 22 of the sheets 21 behind jaw 136. Thus if one or more studs 24 is bent out of alignment, surfaces 181 guide the stud into its proper position and thence through gap 134 into its proper hole 22. It will be understood that each time that the justify/assemble station returns to its forward position, the movable jaw 136 is at its maximum distance apart from jaw 123 and hence the feeding of the male strip 23 is accomplished by the crossfeed 96 of the male strip hopper station 66 regardless of the thickness of the sheets 21.

The female strip 27 is driven horizontally to the right by the crossfeed 96 of female strip hopper station 116 into the gap 129 between the lower edge of the fixed jaw 123 and its subframe 124. Entrance guides 160 prevent strips 27 from deviating from lateral rectilinear movement.

A female strip retainer 161 of sheet metal formed with scallops 162 and controlled by guides 163 is positioned in gap 134 and holds the female strip 27 in place in the jaw 123 while the sheets are being jogged (as hereinafter described). A cam 164 on the retainer 161 is actuated when the assembled sheets and strips are fed off of the justify/assemble station, causing the retainer 161 to move upward so that it does not interfere with transverse movement of the female strip (or of the studs 24 of the male strip 23 which project through the holes 28 in the strip 27.

Notches 166 are formed in both jaws 123 and 136. A left jog member 167 and a right jog member 168 are mounted on jaw 136. These members 167 and 168 are preferably of angle bar stock and, in the forward position of the jaw 136 are vertical. The jaws reciprocate at about 45 degree angle inwardly toward the middle of the jaw and also move in a plane at right angles to the jaw 136 as hereinafter described.

Considering now the right hand member 167, a plate 171 is fixed thereto at about a 45 degree angle with a spacer 169 interposed. Clamp plate 172 behind jaw 136 guides rods 173 which are attached to the plate 171 and extend through bearings in the plate 172. Cylinder 175 also mounted in plate 172 and having its rod fixed to plate 171 causes reciprocation of the jog member 167. It will also be noted that the plate 172 is mounted on the outer ends of a pair of pivot arms 176, the inner ends of which are pivoted to a support 177 at right angles to the jaw 136. Cylinder 178 causes pivotal movement of the plate 172 and of the left jog member 167 from a position above and below the level of jaw 136 when the latter is in forward or down position. Springs 179 bias the member 167 to up position.

The right jog member 168 is substantially similarly but independently controlled by its own cylinders 174 and 175.

There are two functions of the members 167 and 168. When sheets 21 are being loaded onto the tray 52, the right jog member 68 is in up position and may function as a paper stop. When the finger 62 delivers sheets 21 from the tray 52 to the jaw 136, the right jog member 168 is down so as not to interfere with such movement and the left jog member 167 is up to act as a paper stop. However both the members 167 and 168 are pivoted outward so that they subsequently do not interfere with the sheets 21 deposited on the jaw 136 during the initiation of the jogging movement.

After the sheets 21 have been pushed onto the jaw 136, the motor 141 is energized until the finger 148 encounters the sheets 21, thereby discontinuing energization of the motor 141 with the jaws 123 and 136 a distance apart slightly greater than the thickness of sheets 21. Thereupon, the cylinder 131 pivots the jaws 123, 136 to vertical position. Thereupon the cylinders 174 and 178 are rapidly reciprocated causing the members 167 and 168 to jog the sheets, which rest upon the base plate 124 inward into a justified stack whereby the holes 22 are aligned and the edges of the sheets 21 are also aligned. Spacer member 169 between member 172 and either member 167 or 168 cushions the shock of vibration.

At such time as the energization of the cylinders 174 and 178 is discontinued, the pusher 157 is energized by its cylinder 158, pushing the male strip rearward so that the studs 24 extend through the aligned holes 22 in the sheets 21 and also through the holes 28 in the strip 27.

The assembled sheets and strips are then ready for transfer from the station 121 to the bind station 201. A transversely extending transfer chain 186 passes around sprockets 187, rotatably mounted on end pieces 188 (mounted on jaw 123), between which extend rods 189 which pass through bearing block 191, having bearings 193 to receive the rods 189. Cylinder 191 is fixed to end pieces 188. When the cylinder 191 is energized, the rods 189 are moved to the left causing rotation of the chain 186. A discharge lug 194 is fixed to chain 186 and this extends into the space between the jaws 123 and 136 and pushes the assembled book and strips longitudinally from the justify/assembly station 121 to the bind station 201. Pin 199 pins one link of chain 186 to a suitable fixed location on subframe 137, thereby causing lug 194 to move a distance greater than the stroke of cylinder 191, insuring that the assembled book is moved into the bind station.

Bind Station

Bind station 201 is on the left rear portion of the machine. In many respects the mechanisms in bind station 201 resemble those of Pat. No. 3,756,625 and are not described herein in detail. It will be understood that other binding mechanisms, including other hot knife binding mechanisms may be used. Station 201 has a subframe 202 at its rear from which extends forward a book support plate 203 having a platen 204 extending at right angles upward therefrom. Platen 204 slants rearward at the same angle as does jaw 123 when the Justify/Assemble Station 121 is in full rearward position (e.g. 30° from the vertical). When the jog assembly station 121 is at its rearmost position, the upper surface of the fixed jaw 123 is level with the platen 204 when the latter is in its full forward position so that the transfer chain 186 and discharge lug 194 may push the assembled book onto the platen 204. Platen 204 is caused to reciprocate relative to subframe 202 by means of rods 206 fixed to the back of the platen 204 and actuating cylinder 207. On the lower edge of platen 204 is a female strip guard 208 formed with cams 209 so as to lift the guard 208 upward an appropriate distance to allow the strip 27 to contact bridge 221 when the binding cycle is about to commence. Reciprocating along the upper surface of plate 203 is a male strip compressor 211 having connections which extend down through slots 212 in plate 203 engaged by actuating cylinder 204. Thus the compressor strip 211 pushes the male on the assembly toward the female strip which is initially restrained by guard 208, and then further movement of strip 211 causes cams 209 to lift guard 208, compressing strip 27 against bridge 221 (see below) and thereby compressing sheets 21 with a pre-selected pressure.

When the latter pressure is attained, cylinder 204 is held stationary.

Mounted on subframe 202 is a drive motor 216 which through sprockets 217 and 219 and interconnecting chain 218 drives a cam shaft 220.

Behind the platen 204 is a bridge 221 similar to the bridge 101 shown in Pat. No. 3,756,625, the bridge 221 having slots 222 to receive the extended lengths of the studs 224. Slots 223 are formed in platen 204 to receive studs 24. Behind bridge 221 is a knife assembly 226 having knives 227 which, when the assembly 226 moves forwardly, cut off the excess lengths of the studs 24, the knives being heated to make the studs thermoplastic. Cooling fingers 231 in the bridge 221 resemble in function the fingers 141 of said Pat. No. 3,756,625 for forming heads on the severed ends of the studs 24.

Figure 21:
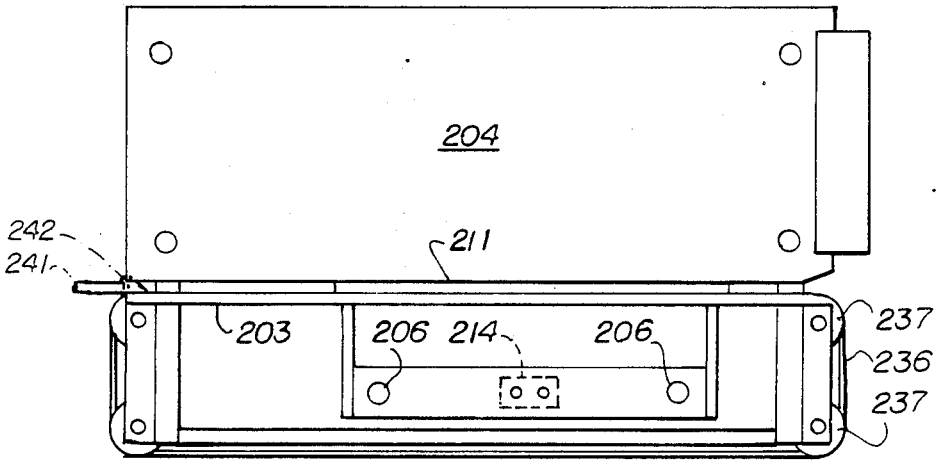
FIG. 21 is a front view of the structure of FIG. 20.
Figure 28:
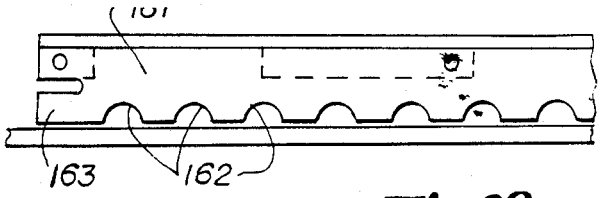
FIG. 28 is a fragmentary view showing the female strip retainer at the justify/assembly station.
Figure 29:
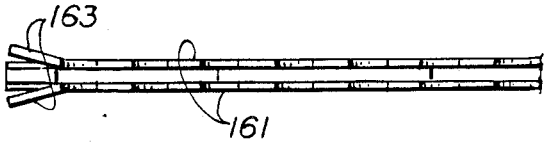
FIG. 29 is a bottom plan of the structure of FIG. 28.
Figure 27:
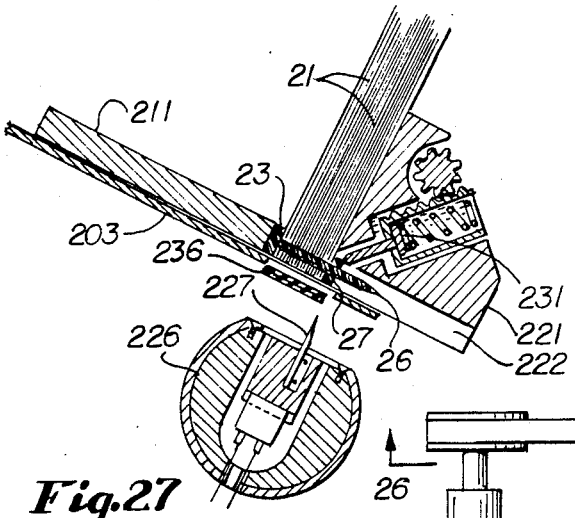
FIG. 27 is a sectional view along line 27—27 of FIG. 1.
Figure 22:
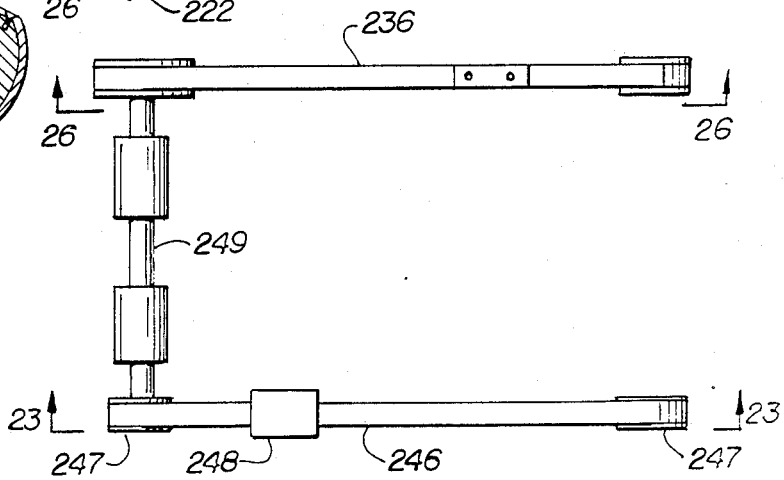
FIG. 22 is a schematic plan view of portions of the structure of FIG. 20.
Figure 26:
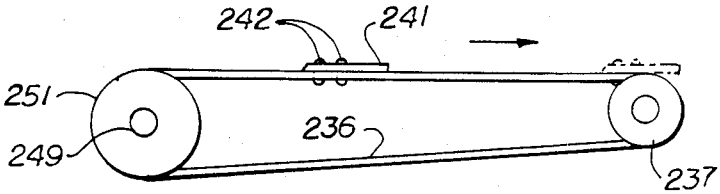
FIG. 26 is a sectional view along line 26—26 of FIG. 22.

When the book has been bound, cylinder 204 reverses and crossfeed belt 236 which has its upper stretch extending immediately forward of bridge 221. Lug 241 attached to belt 236 by rivets 242 at the rear of lug 241 drives the bound book to the left as viewed in FIG. 21 and onto a suitable conveyor or stand (not shown). Horizontal cylinder 238 on the back of subframe 202 drives belt 236. This timing belt 246 passes around pulleys 247 and has a link 248 fixed thereto which is engaged by the rod of cylinder 238. The left pulley 247 (as viewed from the rear of the machine) is connected by shaft 249 to pulley 251. Belt 236 passes around pulley 251 as well as three idler sprockets 237.

Operation

At the commencement of a cycle of operation, the various movable parts of the machine are in the following condition: In the staging station, the pusher finger 62 is retracted (i.e., to the right). In the male strip hopper station, if no strips 23 are in the cassette 31, this is sensed by sensor 81 causing the motor 71 to be energized so that the pins 78 move out of position supporting the empty cassette 31 and the next cassette 31 supported by the next set of pins 78 is lowered into position so that the presence thereof is sensed by sensor 81, whereupon the motor 71 is stopped. During this operation, fingers 87 are retracted (i.e., rearward) so that their presence does not interfere with dropping of the cassettes. In the female strip hopper 116 the same sequence of events is occurring. In the justify/assemble station 121, the jaw 123 is horizontal and level with tray 52. Jaw 136 is in full open (i.e., upward) position. The right guide 168 initially is up and in, but as the cycle commences is retracted down and out (i.e., forward) whereas the left guide 168 is up and out (i.e., to the left). The transfer chain 186 is in position so that the discharge lug 194 is fully retracted (i.e., fully to the right). Female strip retainer 161 is projected (i.e., backward). In the binder station, it may be that the previously assembled book is still in process of being bound. As soon as binding is completed, however, binder platen 204 moves outward (i.e., slanted upward-forward) and male strip compressor 211 is retracted (i.e., upward-outward). The sheet metal female guard 208 is down and the cross-feed belt 236 is stationary.

As the cycle commences, the right guide 168, if it has not already done so, moves down and to the right, whereas the left guide 167 is up and out to function as a paper stop. The paper pusher finger 62 moves to the left, pushing the accumulated stack of sheets to the left and onto the jaw 123 and up against the left guide 167. Thereupon the finger 62 retracts. After the male strip 23 is in place in jaw 123, since finger 148 of sensor switch 147 does not contact any sheets supported on the jaw 123, therefore the motor 141 moves the jaw 136 until finger 148 contacts the uppermost sheets whereupon the motor 141 stops, leaving the jaw 136 positioned a distance from the jaw 123 equal to the thickness of sheets 21 plus a distance such as one-quarter inch which enables the sheets to move relative to each other in the justifying movement of the members 167, 168, but the jaws are sufficiently together so that the sheets do not bend over.

Prior to movement of jaw 136, the strips 23 and 27 are fed. Cylinder 93 is actuated to force fingers 87 rearward insuring that the next strip 23 is positioned on the crossfeed 96—i.e., the strip is pushed forward on the infeed table 99 until the studs 24 are in the slit 102. Thereupon motor 107 is energized causing the strip driver 114 to move the male strip to the left. Cylinder 158 actuates pusher 157 sufficiently so that studs 24 enter grooves 156. Simultaneously, in the strip hopper stations 66 and 116, fingers 87 have been retracted and the crossfeed 96 has pushed the strip 27 horizontally into a position on top of the retainer 161.

With the sheets 21 and strips 23 and 27 now in position in the Justify/Assemble Station, cylinder 131 raises the jaws 123 and 136 to vertical position with the baseplate 122 horizontally therebelow. The jog members 167 and 168 are caused by cylinders 174 and 178 to jog the sheets 21 so that the lower edge margins are flush against the baseplate 122 and the holes 22 are in alignment with the holes 28 in strip 27. Thereupon energization of cylinders 174 and 178 is discontinued and cylinder 158 is actuated causing the pusher 157 to push the studs 24 further toward the strip 27. The conical entrances 160 of the guides 151 and 152 cause the studs to move straight rearward, even if they are initially bent somewhat out of line. Strip 23 forces guides 151 and 152 apart against the force of springs 153 until strip 23 is beyond guides 151 and 152. Thereby the points 26 are pushed through the holes 22 in the entire stack of sheets 21 and through the holes 28 in strip 27.

At this time, cylinder 132 pivots the jaws 123 and 136, as well as baseplate 122, rearward so that baseplate 122 and bind station plate 203 are in alignment. Thereupon the transfer chain 186 is caused to move by virtue of energization of cylinder 191, the discharge lug 194 pushing the assembled but unbound book to the left. The lowermost sheet 21 rests on platen 204 and the female strip guard 208 supports the strip 27, but permits transverse movement of the studs 24. Platen 204, being slanted rearward, supports the assembled book without the necessity of any support for the uppermost sheet.

Cylinder 214 causes male strip compressor 211 to move downward-rearward and the cams 209 cause the female strip guard 208 to be elevated. Hence the strips 23, 27 and the sheets 21 therebetween are compressed to a proper degree of compression as desired, strip 27 being flush against bridge 221. Motor 216 is then energized, turning cam shaft 220. Thereupon the knives 227 cut off the excess lengths of the studs 24 and move toward the strip 27, softening the severed ends of the studs, and then retract. Thereafter the cooling fingers 231 move toward the strip 27, forming and cooling the rivet heads 30 on the ends of the studs. The fingers 231 then retract. Cylinder 214 then retracts and then cylinder 238 is energized, causing the crossfeed belt 236 to discharge the completed, bound book to the left, whereupon it may be conveyed by any suitable apparatus (not shown) to a desired receiving station.

As has been stated previously, the bind station 201 may complete the bind of a book while the jog assembly station 121 and other stations are returning to initial position to justify and assemble the next book which will then be fed into the bind station 201.

It will be understood that there are various limit switches in various locations in the foregoing described machine which insure that each operation of the individual stations is satisfactorily completed before the next operation is begun. However, the various switches and safety means which are incorporated in the machines are not described, since their location and operation is subject to wide variation and will be well understood by one skilled in the art.

What is claimed is:

1. A method for preparing books for binding which comprises the steps of:

providing a stack of sheets each formed with first holes spaced from but adjacent an edge of said sheets and spaced apart in intervals, providing a male strip having projecting studs spaced the same intervals as said first holes, providing a female strip having a plurality of second holes spaced the same intervals as said first holes, assembling said sheets, male strip and female strip with said female strip on a first side of said stack and said male strip in an initial position on a second side of said stack opposite said first side with said studs pointed toward but spaced from said stack, said step of assembling said stack of sheets comprising supporting said stack of sheets horizontal and moving said stack of sheets horizontally onto a support surface, said support surface being initially horizontal and pivoting said support surface to vertical position while loosely supporting said sheets, jogging said sheets to align said first holes with themselves and with said second holes and studs, pushing said studs through said first holes and then through said second holes, and in which said step of assembling further comprises feeding said female strip into position on said first side in a longitudinal direction relative to said edge and feeding said male strip into position in a longitudinal direction relative to said edge on said second side.

2. A method according to claim 1 in which said step of jogging comprises supporting said first-mentioned edges against a second support surface transverse to said first-mentioned support surface and rapidly biasing the outer corners of said stack toward said second support surface and inwardly toward each other.

3. A method for preparing books for binding which comprises the steps of:

providing a stack of sheets each formed with first holes spaced from but adjacent an edge of said sheets and spaced apart in intervals, providing a male strip having projecting studs spaced the same intervals as said first holes, providing a female strip having a plurality of second holes spaced the same intervals as said first holes, a plurality of said male strips being initially packaged in cassettes having spaced parallel side rails with inward facing channels slidably engaging the ends of said strips positioned side-by-side and in which said step of providing a male strip comprises advancing one strip at a time out of a discharge end of a cassette in a first direction parallel to said channels and cross-feeding said one strip in a second direction transverse to said first direction to said initial position, assembling said sheets, male strip and female strip with said female strip on a first side of said stack and said male strip in an initial position on a second side of said stack opposite said first side with said studs pointed toward but spaced from said stack, and pushing said studs through said first holes and then through said second holes, and in which said step of assembling comprises feeding said female strip laterally into position on said first side and feeding said male strip laterally into position on said second side.

4. A method according to claim 3 in which step of advancing said one strip comprises applying pressure toward said one strip to the strip in said cassette most remote from said one strip to slide all strips in said cassette endwise along said channels of said cassette.

5. A method according to claim 3 in which there are initially a plurality of cassettes and which further comprises sensing the absence of strips in a first said cassette, moving said first cassette to a remote position and moving a second cassette into the position initially occupied by said first cassette.

6. A method according to claim 5 in which said plurality of cassettes are stacked and said cassettes are moved downward one at a time as emptied, said first direction being transverse to said downward movement.

7. A method according to claim 1 which further comprises providing stud straightening guides and said step of pushing said studs includes pushing said studs through said guides into alignment with said first and second holes.

8. A method according to claim 1 in which said step of assembling further comprises positioning a third support surface parallel to said first-mentioned support surface above said stack.

9. A method according to claim 8 which further comprises moving said second support surface toward said first-mentioned support until said support surfaces are spaced apart a distance greater than the thickness of said stack.

10. A method according to claim 9 which further comprises sensing the thickness of said stack to determine the distance required to move said second support surface.

11. A method according to claim 1 which further comprises binding a book by compressing said strips together with said stack of sheets therebetween so that the ends of said studs project beyond said female strip and cutting off the excess lengths of studs.

12. A method according to claim 11 which further comprises forming rivet heads on the severed ends of said studs.

* * * * *